US010594073B2

(12) United States Patent
Matlack et al.

(10) Patent No.: US 10,594,073 B2
(45) Date of Patent: Mar. 17, 2020

(54) HIGH-TEMPERATURE INJECTION MOLDED ELECTRICAL CONNECTORS WITH BONDED ELECTRICAL TERMINATIONS

(71) Applicant: Schlumberger Technology Corporation, Sugar Land, TX (US)

(72) Inventors: Bradley Matlack, Shawnee, KS (US); Mark A. Metzger, Lawrence, KS (US); Gregory H. Manke, Overland Park, KS (US); William Goertzen, Lawrence, KS (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/117,725

(22) PCT Filed: Feb. 9, 2015

(86) PCT No.: PCT/US2015/014962
§ 371 (c)(1),
(2) Date: Aug. 9, 2016

(87) PCT Pub. No.: WO2015/120357
PCT Pub. Date: Aug. 13, 2015

(65) Prior Publication Data

US 2017/0170598 A1 Jun. 15, 2017

Related U.S. Application Data

(60) Provisional application No. 61/937,680, filed on Feb. 10, 2014.

(51) Int. Cl.
*H01R 13/533* (2006.01)
*H01R 13/52* (2006.01)
(Continued)

(52) U.S. Cl.
CPC ..... *H01R 13/533* (2013.01); *E21B 17/028* (2013.01); *H01R 13/5205* (2013.01); *H01R 13/5216* (2013.01); *H01R 43/005* (2013.01)

(58) Field of Classification Search
CPC ..... H01R 43/005; H01R 13/5205; H01R 13/533; H01R 13/5216
(Continued)

(56) References Cited

U.S. PATENT DOCUMENTS 4,387,313 A 6/1983 Yamamoto et al.
6,397,945 B1 * 6/2002 Manke ..... H01B 7/046 166/105
(Continued)

FOREIGN PATENT DOCUMENTS

CA 2390528 A1 * 3/2002 ..... H01R 13/5205
CA 2663988 A1 * 10/2009 ..... H01R 13/523
(Continued)

OTHER PUBLICATIONS

International Preliminary Report on Patentability issued in related PCT application PCT/US2015/014962 dated Aug. 16, 2016, 11 pages.
(Continued)

*Primary Examiner* — Abdullah A Riyami
*Assistant Examiner* — Nader J Alhawamdeh

(57) ABSTRACT

A technique facilitates construction of a sealed electrical connector, e.g. sealed pothead assembly. Depending on the application, the electrical connector may be used to connect a power cable and a powered component such as an electric submersible pumping system. The electrical connector comprises at least one connector component and at least one electrical component. An injection molding process is used to construct an injection molded feature sealed to a corresponding component, e.g. to the at least one electrical
(Continued)

component. The injection molded feature is readily formed and located between the at least one electrical component and the at least one connector component to form a simple and reliable seal which prevents unwanted passage of fluids.

18 Claims, 3 Drawing Sheets

(51) Int. Cl.
*E21B 17/02* (2006.01)
*H01R 43/00* (2006.01)

(58) Field of Classification Search
USPC ..... 439/604
See application file for complete search history.

(56) References Cited

U.S. PATENT DOCUMENTS 6,409,485 B1 6/2002 Ebner
6,910,870 B2 6/2005 Ebner
7,666,013 B1 * 2/2010 Kopecky ..... F04D 13/10 417/423.3
8,257,103 B2 9/2012 Costa et al.
8,602,820 B2 * 12/2013 Cortes Roque ... B29C 45/14311 439/604
9,083,101 B2 * 7/2015 Watson ..... E21B 17/023
2002/0048983 A1 4/2002 Lindner et al.
2009/0250235 A1 * 10/2009 Gladd ..... H01R 13/5205 174/34
2009/0317264 A1 * 12/2009 Manke ..... F04B 47/06 417/53
2009/0317997 A1 * 12/2009 Watson ..... E21B 17/023 439/190
2010/0147505 A1 * 6/2010 Manke ..... F04B 47/06 166/66.4
2010/0156215 A1 * 6/2010 Goertzen ..... F04D 13/10 310/87
2011/0130020 A1 * 6/2011 Costa ..... H01R 13/523 439/271
2012/0100737 A1 * 4/2012 Frey ..... H01R 13/523 439/271
2013/0183177 A1 * 7/2013 Manke ..... E21B 17/206 417/422
2013/0272898 A1 * 10/2013 Toh ..... F04D 15/00 417/44.1
2013/0306348 A1 11/2013 Holzmueller et al.
2013/0340245 A1 * 12/2013 Watson ..... F04D 13/08 29/592.1
2014/0209291 A1 * 7/2014 Watson ..... F04D 13/10 166/105
2014/0209292 A1 * 7/2014 Watson ..... F04D 13/10 166/105
2014/0242825 A1 * 8/2014 Watson ..... E21B 17/023 439/275

FOREIGN PATENT DOCUMENTS

CA 2804005 A1 * 1/2012 ..... E21B 17/025
EP 1150392 10/2001
WO 2002023679 A1 3/2002

OTHER PUBLICATIONS

PCT/US2015/014962 International Search Report and Written Opinion, dated May 15, 2015, 14 pgs.

* cited by examiner

HIGH-TEMPERATURE INJECTION MOLDED ELECTRICAL CONNECTORS WITH BONDED ELECTRICAL TERMINATIONS

CROSS-REFERENCE TO RELATED APPLICATIONS

The present document is based on and claims priority to U.S. Provisional Application Ser. No. 61/937,680, filed Feb. 10, 2014, which is incorporated herein by reference in its entirety.

BACKGROUND

In many hydrocarbon well applications, power cables are employed to deliver electric power to various devices. For example, motor lead extensions may utilize a power cable and an electrical connector, sometimes referred to as a pothead assembly. A pothead assembly may include various components including an exterior flange and several sealing mechanisms constructed to prevent gas and other fluids from traveling through the pothead assembly and into a motor during operation. The sealing mechanisms often utilize an elastomeric material which is squeezed against an outer pothead flange and against various internal components, e.g. electrical conductors, to prevent fluids from traveling through the pothead assembly. However, the elastomeric seals can be damaged during installation and/or from exposure to various chemicals, gases, or extreme temperatures. Additionally, use of such elastomeric seals may entail time-consuming and expensive machining and construction techniques to help form an adequate seal.

SUMMARY

In general, a methodology and system are provided which facilitate construction of an electrical connector, e.g. pothead assembly. Depending on the application, the electrical connector may be used to connect a power cable and a powered component such as an electric submersible pumping system. The electrical connector comprises at least one connector component and at least one electrical component. An injection molding process is used to construct an injection molded feature sealed to a corresponding component, e.g. to the at least one electrical component. The injection molded feature is readily formed and located between the at least one electrical component and the at least one connector component to form a simple and reliable seal which prevents unwanted passage of fluids.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a methodology and system which facilitate construction of an electrical connector, e.g. pothead assembly. The technique enables a simple, inexpensive construction of an electrical connector in a manner which prevents leakage of fluids, e.g. gases, through the electrical connector. For example, the electrical connector may be used as a pothead assembly in downhole applications susceptible to high temperatures, high pressures, and/or deleterious fluids. In some well applications, the electrical connector may be coupled to a power cable and used to connect the power cable with an electric submersible pumping system.

According to an embodiment, the electrical connector comprises at least one connector component and at least one electrical component, e.g. an electrical conductor. An injection molding process is used to construct an injection molded feature sealed to a corresponding component, e.g. to the at least one electrical component. The injection molded feature is readily formed and located between the at least one electrical component and the at least one connector component to form a simple and reliable seal which prevents unwanted passage of fluids.

The construction of the electrical connector simplifies, for example, a pothead assembly sealing process and also enables removal of one or more elastomer seals otherwise used in the pothead assembly. The one or more conventional elastomer seals may be removed by virtue of the present construction process comprising bonding an injection molded feature or features with, for example, electrical conductors in the pothead assembly. In this example, the bonding may be achieved via injection molding the feature onto the electrical conductor or conductors to provide a robust and reliable seal which can withstand extreme temperature and pressure changes. The construction of the electrical connector also facilitates use of automated manufacturing processes which enable a greater consistency of assembly and improved sealing of components during the manufacturing processes.

Figure 1:
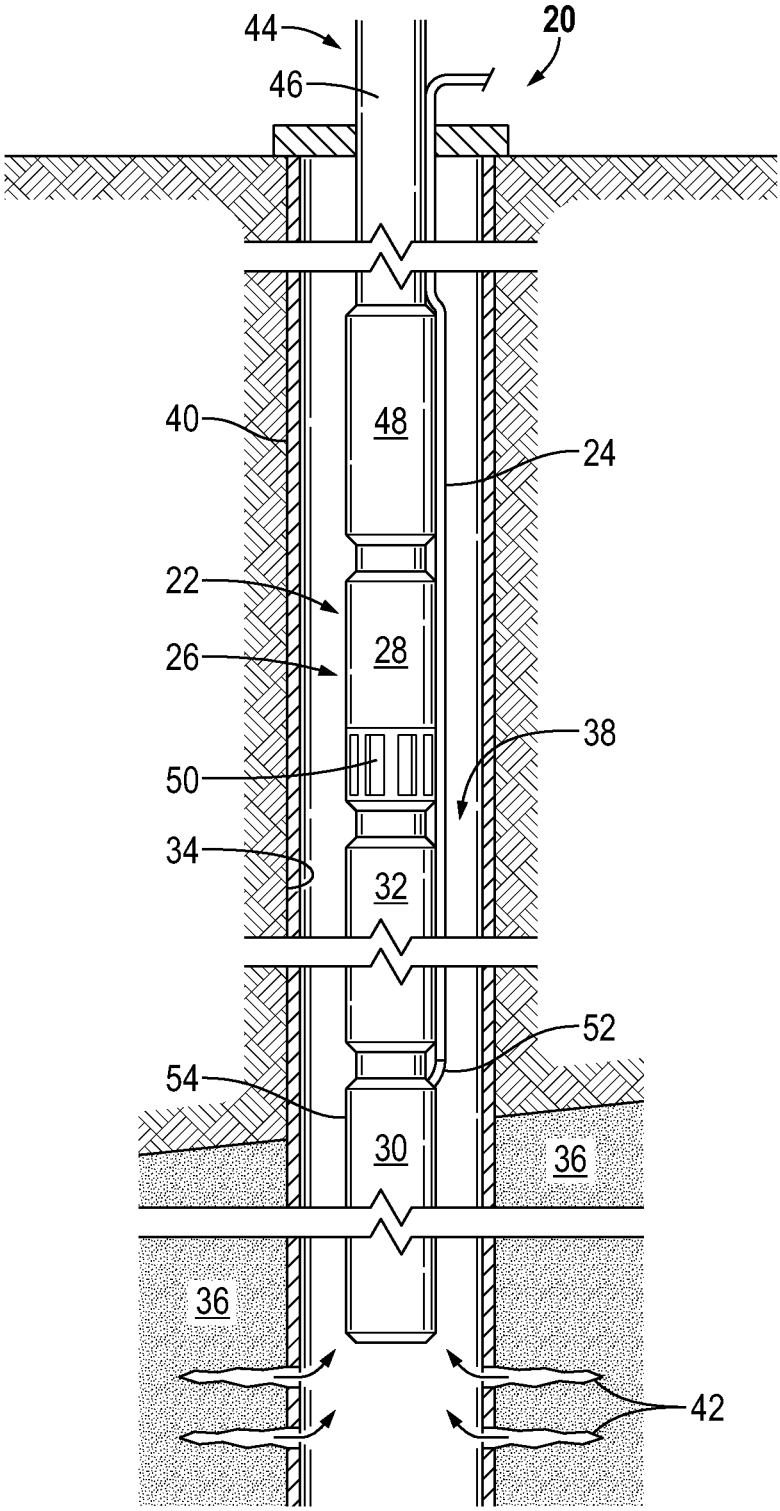
FIG. 1 is a schematic illustration of a well system comprising an electrical power cable coupled with an electric submersible pumping system via an embodiment of an electrical connector, according to an embodiment of the disclosure.

Referring generally to FIG. 1, an embodiment of a well system is illustrated as comprising a downhole, electrically powered system, e.g. an electric submersible pumping system. Electric power is provided to the electric submersible pumping system or other powered system via a power cable. The power cable, in turn, is coupled with the electrically powered system by an electrical connector, e.g. a pothead assembly. In some applications, the power cable may be part of a motor lead extension. The illustrated electric submersible pumping system or other types of electrically powered systems may comprise many types of components and may be employed in many types of applications and environments, including cased wells and open-hole wells. The well system also may be utilized in vertical wells or deviated wells, e.g. horizontal wells.

Referring again to FIG. 1, a well system 20 is illustrated as comprising an electrically powered system 22 which receives electric power via an electrical power cable 24. By way of example, the electrically powered system 22 may be in the form of an electric submersible pumping system 26, and the power cable 24 is designed to withstand high temperature, harsh environments. Although the electric submersible pumping system 26 may have a wide variety of components, examples of such components comprise a submersible pump 28, a submersible motor 30, and a motor protector 32.

In the example illustrated, electric submersible pumping system 26 is designed for deployment in a well 34 located within a geological formation 36 containing, for example, petroleum or other desirable production fluids. A wellbore 38 may be drilled and lined with a wellbore casing 40, although the electric submersible pumping system 26 (or other type of electrically powered system 22) may be used in open hole wellbores or in other environments exposed to high temperatures and harsh conditions. In the example illustrated, however, casing 40 may be perforated with a plurality of perforations 42 through which production fluids flow from formation 36 into wellbore 38. The electric submersible pumping system 26 may be deployed into a wellbore 38 via a conveyance or other deployment system 44 which may comprise tubing 46, e.g. coiled tubing or production tubing. By way of example, the conveyance 44 may be coupled with the electrically powered system 22 via an appropriate tubing connector 48.

In the example illustrated, electric power is provided to submersible motor 30 by electrical power cable 24. The submersible motor 30, in turn, powers submersible pump 28 which draws in fluid, e.g. production fluid, into the pumping system through a pump intake 50. The fluid is produced or moved to the surface or other suitable location via tubing 46. However, the fluid may be pumped to other locations along other flow paths. In some applications, for example, the fluid may be pumped along an annulus surrounding conveyance 44. In other applications, the electric submersible pumping system 26 may be used to inject fluid into the subterranean formation or to move fluids to other subterranean locations.

As described in greater detail below, the electrical power cable 24 is designed to consistently deliver electric power to the submersible pumping system 26 over long operational periods in environments subject to high temperatures, high pressures, deleterious fluids, and/or other harsh conditions. The power cable 24 is connected to the corresponding, electrically powered component, e.g. submersible motor 30, by an electrical connector 52, e.g. a suitable pothead assembly. The electrical connector 52 provides sealed and protected passage of the power cable conductor or conductors through a housing 54 of submersible motor 30. The electrical connector 52 may utilize one or more injection molded features which provide a simple and reliable seal against unwanted passage of fluids through the electrical connector 52 while eliminating one or more elastomer seals used in conventional pothead assemblies.

Depending on the application, the power cable 24 may comprise an individual electrical conductor protected by an insulation system or a plurality of electrical conductors protected by the insulation system. In various submersible pumping applications, the electrical power cable 24 is in the form of a motor lead extension. In many of these applications, the motor lead extension 24 is designed to carry three-phase current, and submersible motor 30 comprises a three-phase motor powered by the three-phase current delivered through the three electrical conductors of motor lead extension 24.

Figure 2:
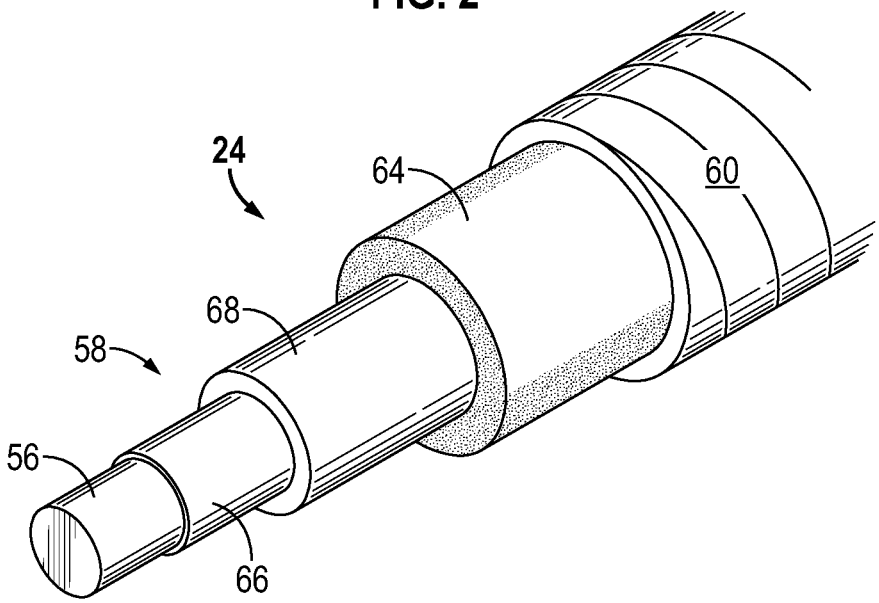
FIG. 2 is a cutaway view of an example of an electrical power cable which may be used to supply electric power to an electrically powered system, according to an embodiment of the disclosure.

Referring generally to FIG. 2, an example of electrical power cable 24, e.g. motor lead extension, is illustrated. In this example, the power cable 24 comprises an electrical conductor 56 and an insulator 58 disposed around the electrical conductor 56. An outer protective layer 60, e.g. armor or metallic tubing, is disposed around the insulator 58. In many applications, the outer protective layer/armor 60 provides a robust, metallic layer which is mechanically strong and corrosion resistant. For example, the outer protective layer 60 may be formed with lead or a variety of steel alloys or other materials which provide strength and corrosion resistance. In some applications, the outer protective layer 60 may comprise a non-lead, strong, metallic tube constructed to increase the longevity and reliability of electrical power cable 24 while also offering a smooth and robust exterior surface for metal-to-metal seal construction.

A jacket 64 may be disposed radially between the insulator 58 and the outer protective layer 60. The jacket 64 may be formed from a variety of materials including a compressible material, such as an elastomeric material, which is able to compensate for different coefficients of thermal expansion between adjacent materials, such as different coefficients of thermal expansion between the material forming jacket 64 and the material forming outer protective layer 60. In many applications, jacket 64 may be formed from elastomeric material which has a higher coefficient of thermal expansion and thus a greater thermal expansion than the outer layer 60 for a given increase in temperature.

Depending on the application, the jacket 64 may be bonded to the insulator 58 or left unbonded. A number of different elastomers may be used to form jacket 64, including EPDM, HNBR, NBR, SBR, Silicones, Fluorosilicones, chlorinated polyethylene, chloroprene, butyl, FEPM, or other types of elastomers. In some applications, the material of jacket 64 may be processed into a sponge compound.

However, the power cable 24 may be constructed with various other features and materials. For example, the electrical power cable 24 may comprise a variety of other and/or additional components depending on the environment in which the power cable 24 is to be employed and on the parameters of a given application. Depending on the application, insulator 58 may comprise a variety of insulating materials and constructions. In some embodiments, the insulator 58 may comprise an individual layer, and other embodiments may utilize a plurality of insulation layers, e.g. insulation layers 66 and 68. Each layer of the plurality of layers may be formed of a different material and/or a different type of construction. For example, insulation layer 66 may comprise a tape wrapped insulation layer which is wrapped over the electrical conductor 56. Insulation layer 68 may comprise an extruded insulation layer which is extruded over the tape wrapped insulation layer 66. These and other configurations of insulator 58 may be used to provide the desired insulation between electrical conductor 56 and jacket 64.

Figure 3:
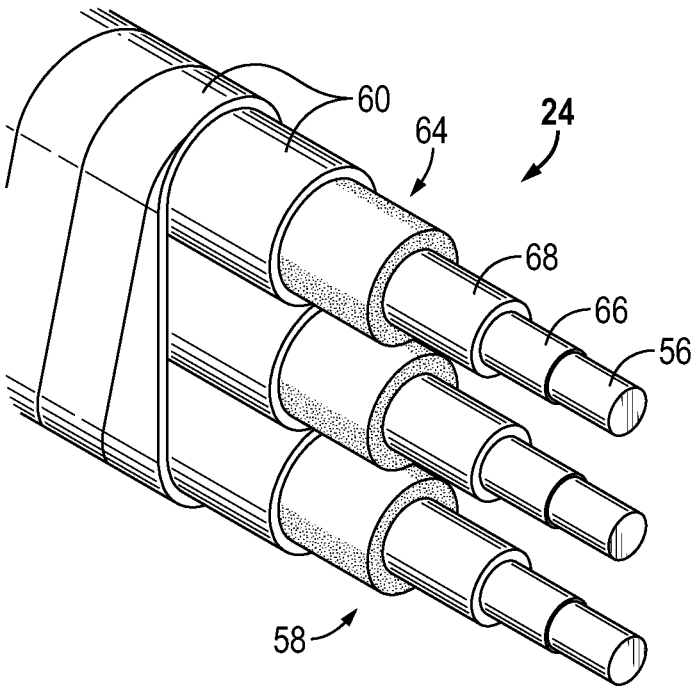
FIG. 3 is a cutaway view of another example of an electrical power cable which may be used to supply electric power to an electrically powered system, according to an embodiment of the disclosure.

The electrical power cable 24 also may be constructed in a variety of configurations having, for example, an individual electrical conductor 56 or a plurality of electrical conductors 56. For example, a plurality of electrical conductors 56 may be arranged to form a generally flat power cable, as illustrated in FIG. 3. In this example, jacket 64 may be disposed individually around each electrical conductor 56 and its associated insulator 58. Similarly, the outer protective layer 60 may be positioned individually around each jacket 64 and/or the outer protective layer 60 may be positioned collectively around the plurality of electrical conductors 56.

In the example illustrated in FIG. 3, the electrical power cable 24 is illustrated as having three electrical conductors 56. Depending on the application, other numbers of electrical conductors may be employed to deliver power to, for example, the downhole electrically powered system 22. In many applications, the use of three electrical conductors 56 allows delivery of three-phase power to the electrically powered system 22. For example, the power cable 24 may be designed as a three-phase power cable for delivering three-phase power to submersible motor 30 of electric submersible pumping system 26. In such applications, the electric submersible pumping system motor 30 is designed as a three-phase motor.

Figure 4:
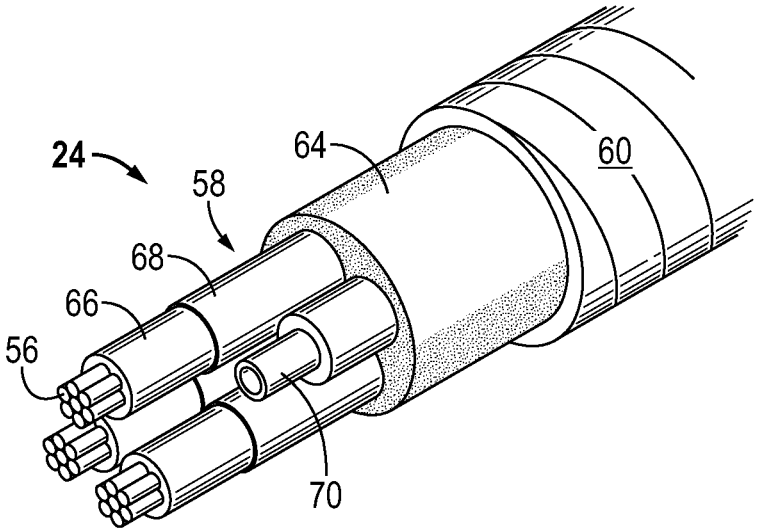
FIG. 4 is a cutaway view of another example of an electrical power cable which may be used to supply electric power to an electrically powered system, according to an embodiment of the disclosure.

Referring generally to FIG. 4, an example is provided of a power cable 24 having a plurality of electrical conductors collectively surrounded by jacket 64. In this example, a plurality of electrical conductors, e.g. three electrical conductors for carrying three-phase power, is deployed within the power cable 24. By way of example, each electrical conductor 56 may be individually surrounded by insulator 58. The collective group of electrical conductors 56 and associated insulators 58 is surrounded by jacket 64, as illustrated. The collective jacket 64, in turn, is positioned within outer protective layer/armor 60. In some applications, an additional control line or control lines 70, e.g. hydraulic control lines and/or fiber optic control lines, may be positioned within the power cable 24.

Figure 5:
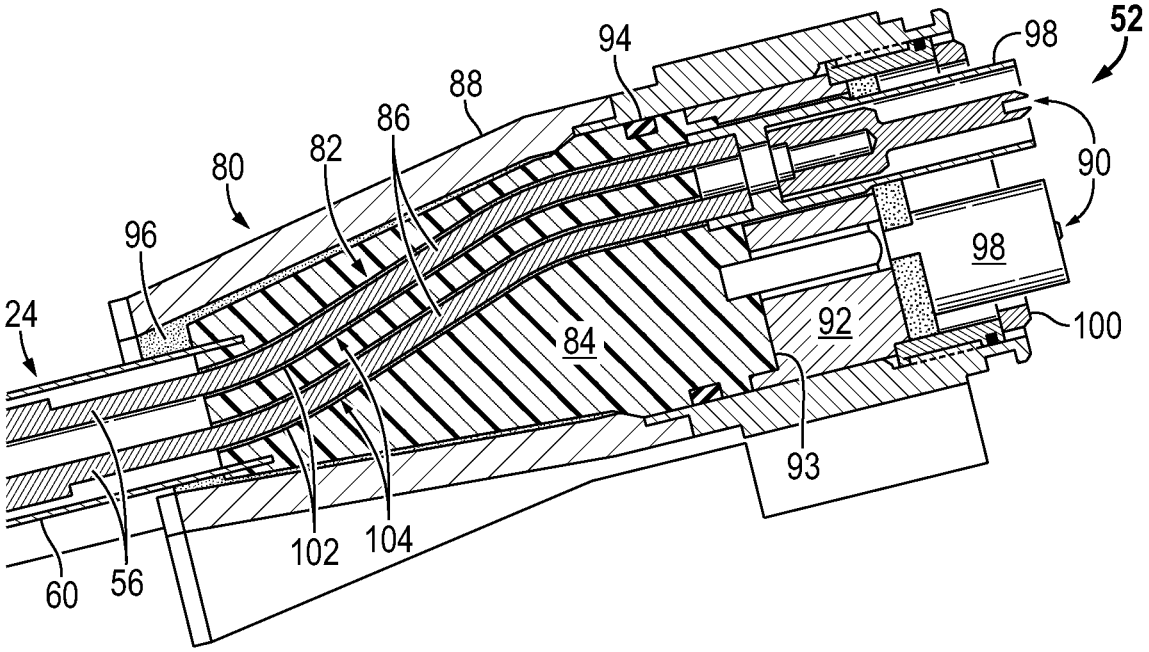
FIG. 5 is a cross-sectional view of an example of an electrical connector, according to an embodiment of the disclosure.

Referring generally to FIG. 5, an embodiment of electrical connector 52 is illustrated. In this example, at least one electrical connector component 80, e.g. pothead assembly component, and at least one electrical component 82 are provided with an injection molded feature 84 therebetween. The injection molded feature 84 may be directly molded to the connector component 80 and/or the electrical component 82 by a suitable injection molding process so as to prevent passage of undesirable fluids. By way of example, the at least one electrical component 82 may comprise an electrical conductor 86 or conductors 86 and the injection molded feature 84 may be directly molded onto the electrical conductor(s) 86 via the injection molding process.

In the specific example illustrated, the connector component 80 comprises a connector housing 88, e.g. a flange, positioned around the exterior of a plurality of the electrical conductors 86. In this embodiment, the feature 84 is injection molded onto the plurality of the electrical conductors 86 to ensure a reliable seal along the electrical conductors 86 so as to prevent ingress of undesirable fluids through the electrical connector 52. In some examples, the electrical conductors 86 are end sections of electrical conductors 56 of power cable 24 which have been sealed within the injection molded feature 84 via the injection molding process. On an opposite end relative to power cable 24, the electrical conductors 86 may be coupled with connector ends 90, e.g. terminals, constructed for engagement with corresponding terminals within submersible motor 30 or other electrically powered device or system.

According to some embodiments, a front block component 92 may be positioned around a base of the connector ends 90 adjacent a front surface 93 of injection molded feature 84. In some applications, at least one elastomer seal 94 may be positioned between the injection molded feature 84 and the surrounding flange/housing 88 to prevent fluid, e.g. gas, from traveling between the outside of the molded feature 84 and the interior surface of the flange 88. Additionally, an epoxy 96 or other suitable filler material may be placed within a back end of the connector housing 88 and around the power cable 24 to further seal the power cable 24 with respect to the electrical connector 52. Depending on the application, the electrical connector 52 also may comprise other suitable features, such as shrouds 98 positioned around the extending connector ends 90 as well as a packing gland 100 positioned around the connector ends 90 at a front end of the electrical connector 52.

The configuration of and the material used to form injection molded feature 84 may be selected according to the parameters of a given application. In various well applications, the electrical connector 52 may be in the form of a pothead assembly and the injection molded feature 84 may be injection molded around one or more of the electrical conductors 86 so that a bond is created between the molded feature 84 and the conductors 86. The bond provides a long-lasting seal which prevents fluids, e.g. gas, from passing through the electrical connector 52 between the electrical conductors 86 and the injection molded feature 84.

According to an embodiment, the injection molded feature 84 may utilize a high temperature, thermoplastic material which is readily injection molded to enable feature 84 to be formed in a desired configuration as it is molded onto electrical conductor(s) 86 (and/or onto another electrical component 82 or connector component 80). By way of example, the injection molded feature 84 may be formed from materials in the polyaryletherketone (PAEK) family of materials and/or from materials in the fluoroplastic family of materials.

In a variety of applications, the electrical conductors 86 (or an insulation layer surrounding each electrical conductor 86) may have a different material composition relative to the material used to form injection molded feature 84. It should be noted that in some applications, the electrical conductors 86 which extend through the surrounding housing/flange 88 may include an insulation layer 102. Thus, some embodiments may employ a cross-linking technique or a co-crystallization technique to enhance bonding of the injection molded feature 84 with the electrical conductor(s) 86. Additionally, selected mold heating and cooling techniques may be utilized to create a desired bond between the injection molded feature 84 and the electrical conductor(s) 86. The mold heating and cooling techniques also may be employed to produce desired material properties in, for example, the injection molded feature 84 and insulation layer 102.

An intermediate adhesive 104 also may be employed to bond the similar or dissimilar materials used to form the injection molded feature 84 and the insulation layer 102. In some applications, the bonding materials, e.g. materials forming molded feature 84, insulation layer 102, and/or adhesive 104, may be filled with high-modulus, low thermal expansion fillers having desired dielectric properties. Examples of such fillers include quartz, E-glass, S-glass, or other suitable fillers. It should be noted that the various materials and bonding techniques have been described with respect to bonding the injection molded feature 84 with the at least one electrical conductor 86, but the materials and bonding techniques may be employed when using an injection molding process to bond the injection molded feature 84 with other electrical components 82 and/or connector components 80.

Depending on the application, the electrical connector 52 may have a variety of shapes and/or components. The injection molded feature 84 also may be molded onto a variety of individual or plural components. The materials used to form feature 84 may be selected according to the parameters of a given application and environment. Additionally, a variety of supplemental bonding techniques may be employed to ensure a long-term dependable seal between the molded feature 84 and the component to which the material is molded. Various applications may utilize a variety of injection molding techniques. Similarly, the molding technique may be adjusted according to the selection of materials to be molded and the type of seal to be formed.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method of manufacturing a pothead assembly, comprising:

providing at least one pothead assembly component and at least one electrical component; and injection molding an injection molded feature between the at least one pothead assembly component and the at least one electrical component so as to bond the injection molded feature in a sealing engagement with at least one of: the at least one electrical component; and the at least one pothead assembly component, wherein the injection molded feature comprises a material having dielectric properties.

2. The method as recited in claim 1, wherein the at least one pothead assembly component comprises a protective flange.

3. The method as recited in claim 1, wherein the sealing engagement comprises cross-linking or co-crystallization to bond the injection molded feature with the at least one electrical component.

4. The method as recited in claim 1, wherein the injection molded feature comprises a high modulus, low thermal expansion bonding material.

5. The method as recited in claim 1, further comprising coupling the pothead assembly with an electric submersible pumping system.

6. The method as recited in claim 1, wherein providing the at least one electrical component comprises providing a plurality of electrical conductors.

7. The method as recited in claim 6, wherein injection molding the injection molded feature comprises molding the injection molded feature to the plurality of electrical conductors and positioning the injection molded feature within a surrounding flange.

8. A system, comprising:

a pothead assembly having:

a connector housing;

an electrical component routed through an interior of the connector housing; and an injection molded feature formed by injection molding within the connector housing and bonded to at least one of the connector housing and the electrical component so as to form a seal and prevent passage of fluid between the electrical component and the connector housing, wherein the injection molded feature comprises a high temperature thermoplastic material.

9. The system as recited in claim 8, additionally comprising an electric motor wherein the electrical component is connected to a terminal of the electric motor.

10. The system as recited in claim 9, additionally comprising an electric submersible pump operably connected to the electric motor.

11. The system as recited in claim 8, further comprising an elastomer seal positioned between the injection molded feature and the connector housing.

12. A method for forming a pothead assembly comprising:

injection molding a feature comprising a first material composition directly around a conductor comprising a second material composition such that the feature is bonded in a sealing engagement with the conductor to form a seal configured to prevent passage of fluid between the conductor and a connector housing of the pothead assembly.

13. The method as recited in claim 12, wherein the pothead assembly is configured to provide a sealed connector between a power cable and a powered well component.

14. The method as recited in claim 12, wherein the pothead assembly is configured to couple the conductor with an electric submersible pumping system.

15. The method as recited in claim 12, comprising layering an elastomer seal between the feature and the connector housing.

16. The method as recited in claim 1, comprising lining at least a portion of the at least one pothead assembly component with an epoxy such that the injection molded feature seals against the epoxy.

17. The method as recited in claim 16, wherein the epoxy forms a seal between a power cable and the at least one pothead assembly component, wherein the power cable comprises the electrical component.

18. The method as recited in claim 12, wherein the connector housing comprises an epoxy on an interior of the connector housing, wherein the feature bonds to the epoxy to form the seal.

* * * * *